United States Patent [19]

Frentzel

[11] 4,236,567

[45] Dec. 2, 1980

[54] FASTENING MEMBER FOR SECURING THE SLATS OF A VENETIAN BLIND TO A SUPPORT ELEMENT AND METHOD FOR ASSEMBLY

[75] Inventor: Kurt H. Frentzel, Zevenhoven, Netherlands

[73] Assignee: Hunter Douglas International N.V., Netherlands Antilles

[21] Appl. No.: 911,824

[22] Filed: Jun. 2, 1978

[30] Foreign Application Priority Data

Jun. 7, 1977 [DE] Fed. Rep. of Germany ..... 2725600

[51] Int. Cl.[3] ..... E06B 9/38

[52] U.S. Cl. ..... 160/178 R

[58] Field of Search ..... 160/173, 177, 178 R, 160/178 F

[56] References Cited

U.S. PATENT DOCUMENTS 3,916,973 11/1975 Schuppler et al. ..... 160/178 R

FOREIGN PATENT DOCUMENTS 186404 8/1954 Austria ..... 160/178 R

*Primary Examiner*—Peter M. Caun

*Attorney, Agent, or Firm*—Pennie & Edmonds

[57] ABSTRACT

This invention relates to a fastening member for securing the slats of a venetian blind onto a flexible support element and to the method of assembling such slats to the support elements. The fastening member comprises a generally "U" shaped member in which the legs of the "U" have at their outer ends laterally outwardly extending abutments for engagement on one side of the slat while the remainder of the fastening member extends through an opening through the slat. A loop on the flexible support element passes between the legs of the "U" thus tending to hold the abutments in engagement with the surface of the slat. On the opposite side of the slat cam locks are provided such that upon flexure of the legs toward each other the cams will pass through the opening in the slat and then upon release when the legs resume their normal position the cams will engage and lock the slat in position between the cam locks and the aforesaid abutments. A narrow entrance slot with a tapered entrance throat provides for passage therethrough of the loop thus permitting passage of the loop between the legs into the space therebetween. Importantly, the fastening member is so dimensioned in one direction that the abutments are larger than the opening in the slat. In a second direction substantially perpendicular to said first direction the fastening member is dimensioned to pass through the opening in the slat. After engagement with the loop the fastening member is passed through the opening in the slat, rotated 90 degrees, and then all but the abutment portion of the fastening member is snapped back through the opening.

9 Claims, 6 Drawing Figures

FIG. 1
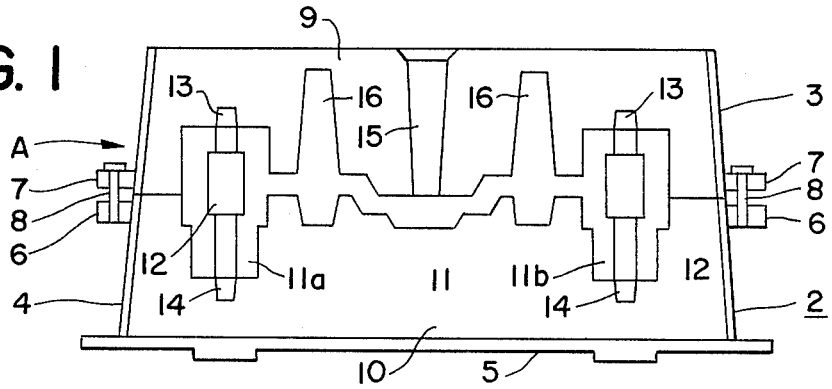
FIG. 2
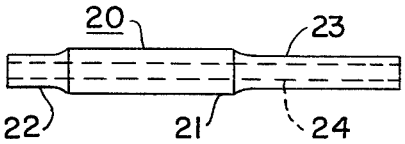
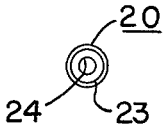
FIG. 3
FIG. 4
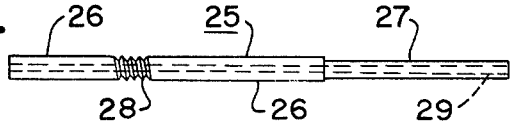
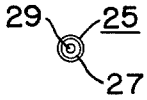
FIG. 5
FIG. 6
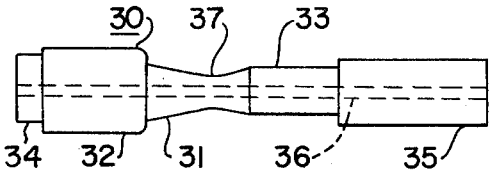
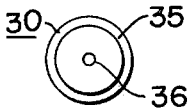
FIG. 7
FIG. 8
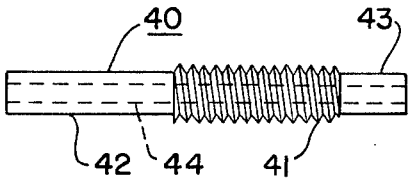
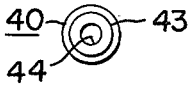
FIG. 9
FIG. 10
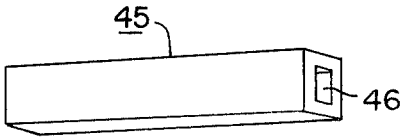
FIG. 11
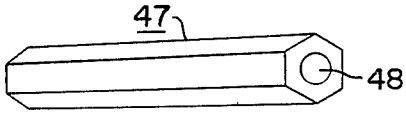

FASTENING MEMBER FOR SECURING THE SLATS OF A VENETIAN BLIND TO A SUPPORT ELEMENT AND METHOD FOR ASSEMBLY

BACKGROUND OF THE INVENTION

1. Field of the Invention

Known fastening members of the type to which the invention is directed are generally such that after assembly the major forces and the most common forces applied by the flexible support member to the fastening member are applied in a direction tending to disengage the fastening member from its engagement with the slat. As such any excessive loads applied to the attachment will cause the same to disengage and release the slat from its connection with the support member.

2. Prior Art

West German utility model Pat. No. 7,023,216.5 published Sept. 17, 1970, discloses three embodiments of a fastening member for fastening a venetian blind slat to a flexible support member. Of the three embodiments shown, two involve a fastening member in which a loop of the flexible supporting member is engaged by the fastening member and then the fastening member is snapped into place in an opening in the slat. In the third embodiment the fastening member does not pass through an opening in the slat but rather engages the opposite lateral side edges of the slat. In both of the two embodiments in which the fastening member snaps into place in an opening in the slat, the forces applied to the slat by the supporting member are generally in a direction such as to tend to cause disengagement of the fastening member from the opening in the slat. In the event of excessive forces being applied to the fastening member the same can become disengaged from the slat thus freeing the same from the support member.

BRIEF SUMMARY OF THE INVENTION

The present invention overcomes the lack of reliability of the fastening members above described by insuring that forces applied to the fastening member by the flexible support member are applied generally in a direction opposite to that by which the fastening member may be removed from its position in the opening of a slat. Further, such slight forces as may occasionally, but not often, be applied in a direction to unseat the fastening member from an opening in a slat are also prevented from disengaging the fastening member from the slat by locking cams.

To this end the present fastening member comprises a "V- or U-" shaped member which has outwardly extending flages or abutments extending outwardly from the terminus of each of the legs of the "U". The overall dimension taken in a first direction measured from the outer terminus of one abutment to the outer terminus of the other abutment is of a size greater than the opening in the slat with which it is to be joined. In a second direction taken at substantially 90 degrees with respect to said first direction the fastening member is small enough to pass easily through the opening in the slat. The space between the legs adjacent to the bight of the "U" shaped member is adapted to receive the loop of a flexible support member. Adjacent the terminus of each of the legs the abutments extend toward each other but do not meet. In this way a slot is provided through which the loop may pass into the larger space between the legs of the fastening member. This slot tapers outwardly to provide an enlarged entrance to the narrow slot. The fastening member of the invention may be made of any suitable material such as steel; however, plastic is presently preferred.

It is preferred that the abutments extend at right angles to the legs at their ends in generally the plane of the "U". On the outer surface of the legs a locking cam on each serves as a stop which is apced from the facing surface of the abutments by a distance approximating the thickness of the slat. Preferably, this dimension is such as to be tight enough to prevent rattling yet loose enough to permit ready assembly without force or the use of tools. Once in place the locking cams prevent the fastening member from being removed from the slat by any forces, not frequently encountered, which might be applied in a direction opposite to the forces applied by the support member to the fastening member.

It is preferred that the width of the narrow slot provided for insertion of the loop of the support member be such that upon inward bending of the legs they may be flexed only to the extend that their inwardly facing portions engage each other and at the same time the outer dimensions in said first direction from the outer edge of one of said abutment to the outer edge of the other still remains larger than the opening. Thus even flexure of the legs towards each other will not permit removal of the fastening member in the direction in which force is applied thereto by the support member. To further guard against looseness or rattling the dimension and shape of the fastening member in the area between the facing surfaces of the locking cams and the abutments are designed to just snugly fit within the opening in the slat which also prevents the shifting of the slat relative to the flexible member and thus misalignment of the slats.

It is further preferred and advantageous that the outer contours of the fastening member be rounded particularly the outer surfaces of the abutments and the outer surface of the central bight portion which connects the legs of the "U".

By use of the fastening member of this invention the method of assembly of a blind is greatly simplified. Preferably all of the fastening members are connected with the support element first with each loop of the supporting element being first passed through the narrow slot between the adjacent portions of the abutments and into the enlarged open area between the legs of the fastening member. Thereafter, each fastening member is inserted end-wise through the opening in the slat. That is to say that it is inserted in the first direction mentioned above with respect to the first dimension from the outer edge of one abutment to the outer edge of the other abutment. The fastening member is dimensioned in the second direction (90 degrees to the first direction) to just pass through the opening. After completely passing through the opening the fastening member is then rotated 90 degrees such that the outer surface of the bight of the "U" faces the opening through which it has just passed. The fastening member then may be snapped into the opening due to the resiliency of the material and in particular of the legs of the "U". This permits the legs to move together until the inner edges of the abutments engage each other. At this point the legs are close enough together to permit the cam locks to pass back through the opening. After the cam locks have been passed through the opening the legs are released and they spring back into their normal position with the cam locks positioned on one side of the slat and the abutment on the other side of the slat with the thickness of the slat between their facing surfaces. Any forces exerted upon the fastening member by the support member merely causes the abutments to bear more firmly against the adjacent surface of the slat and there is no danger of the same springing back through the opening. Removal of the fastening member in the opposite direction is prevented by the cam locks and in any event any forces applied in such direction are slight and infrequent.

BRIEF DESCRIPTION OF THE DRAWINGS

The construction and method above briefly described will be fully understood by those skilled in the art by reference to the following description and the drawings in which.

Figure 2:
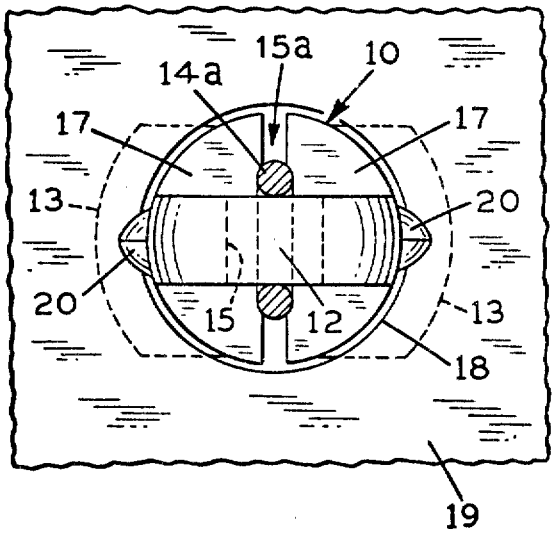
FIG. 2 shows a top plan view of the fastening member after having been completely inserted in the opening in a slat.

As shown in the figures the fastening member 10 is substantially "U" shaped and comprises two substantially parallel legs 11, a bight portion 12 connecting the legs 11, and abutments 13 at the ends of the legs 11 which abutments 13 extend outwardly at substantially a right angle with respect to the respective leg 11 and inwardly toward each other from the legs 11.

The inner side of the bight 12 is smoothly rounded at 12*a* to form a round bearing surface for the loop 14*a* of a flexible support member 14. A narrow slot at 15*a* provides an entrance way to the larger opening 15 between the legs 11. Narrow outwardly widening surfaces 16 on the abutments 13 provide for a wide entrance way to the slot 15*a*. It will be appreciated by those skilled in the art that the support member 14 and the loops 14*a* may be of any suitable material including metal or plastic and may be in the form of a cable, wire, rope, cord, chain or the like. Synthetic fibrous cord that is strong, soil resistant and readily cleanable is preferred.

Extending outwardly from the outer surface of each leg 11 is a locking cam 20 which has a tapered surface facing away from the abutments 13 and a relatively straight surface facing towards the abutments 13.

Figure 1:
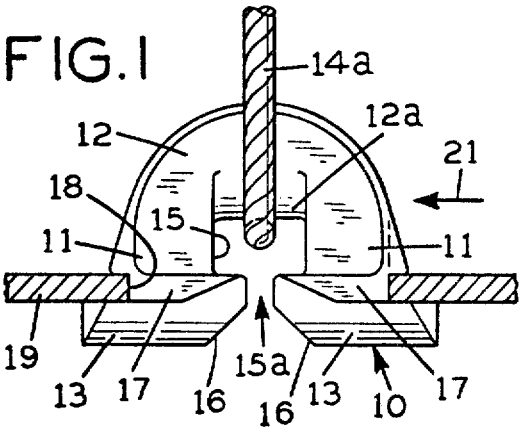
FIG. 1 shows a side elevation of the fastening member of the invention.

In the area between the abutments 13 and the cam locks 20 is an opening engaging portion 17 shaped to conform to the shape of the opening 18 into which it is to be inserted. As shown the opening 18 and the portion 17 are circular though other shapes such as polygonal, square, rectangular and the like are contemplated. The external dimensions of the portion 17 are such as to snugly but releasably engage the edges of the opening 18 thus providing for lateral security and protecting against rattling and the like. The vertical dimension of the portion 17 (as viewed in FIG. 1) is such as to receive the thickness of the slat 19 snugly but releaseably therein. That is to say that the space between the upper (as viewed in FIG. 1) surface of the abutments 13 and the facing surfaces (facing downwardly in FIG. 1) of the cam locks 20 is just slightly greater than the thickness of the slats 19.

Figure 3:
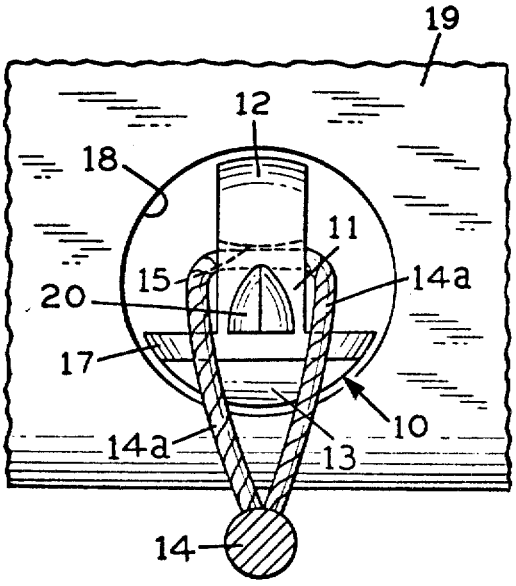
FIG. 3 is an end elevation of the fastening member as it is being inserted through the opening in a slat.

The outer surfaces of the legs 11 are curved, and preferably concentric but slightly smaller than, the opening 18 as shown in FIG. 2. As best shown in FIG. 3 the upper outer surface of the bight portion 12 and the lower outer surfaces of the abutments 13 are also curved and preferably are arcs of a concentric circle of slightly smaller radius than the circle of the opening 18.

The fastening member is so dimensioned in a first direction that the distance between the outer terminus of one abutment 13 and the outer terminus of the other abutment 13 (the overall dimension from left to right as viewed in FIG. 1) is greater than the opening 18. The overall dimension from one cam 20 to the other in the same first direction also normally exceeds the size of the opening 18. However, upon flexion of the legs 11 towards each other the inner facing surfaces of the abutments forming the slot 15*a* approach each other and at or before the point at which these facing surfaces 16 of the abutments 13 actually come into contact the outer dimension of the cams 20 will have been reduced sufficiently to permit passage through the opening 18. Thus at that point the fastening member may be inserted in or removed from the opening 18. Preferably even if the legs 11 are flexed toward each other to the point where the slot 15*a* is completely closed by the facing surfaces 16 of the abutments 13 coming into contact with each other, the overall lateral dimension, in said first direction of the fastening member from the outer terminus of one abutment to the outer terminus of the other abutment is still greater than the diameter of the opening 18 and thus the fastening member may not be passed completely through in the direction of load applied by the loop 14*a*. The overall dimension of the fastening member 10 in a second direction taken substantially at a right angle to said first direction (vertically in FIGS. 1 and 3) is sufficiently small as to just easily pass through the opening 18. Thus said fastening member has a greater dimension in said first direction than in said second direction.

METHOD OF ASSEMBLY.

A loop 14 a of the support member 14 is introduced through the wide but narrowing throat defined by the surfaces 16 on the abutments 13 and through the slot 15*a* into the opening 15 of the fastening member 10. Preferably, but not necessarily, all of the fastening members for an entire venetian blind are secured to their respective supporting elements first; however, if desired each may be engaged with its respective loop 14*a* and then inserted in the slat as described below. It has been found, however, that in assembly in a factory it is generally advantageous to assemble all of the fastening members to their respective loops 14*a* first.

After the loop 14*a* has been engaged in the wide portion 15 of the slot between the legs 11 then the member 10 is passed endwise through the opening 18 as shown in FIG. 3. FIG. 3 shows the end of the fastening member 10 looking in the direction of the arrow 21 in FIG. 1 but taken as fastening member 10 is being inserted into the slat opening 18 of the slat 19. As the member 10 is passed through the opening 18 of the slat 19 as shown in FIG. 3 the loop 14*a* goes with it. Upon completely inserting the member 10 through the opening 18 then the entire fastening member 10 will be on one side of the slat 19, the support member 14 will be on the other side of the slat 19 and the loop 14*a* will be extending through the opening 18 between the fastening member 10 and the support member 14.

At this point the fastening member 10 is rotated 90 degrees until the outer (upward surface as viewed in FIG. 1) faces back through the opening 18. At this point force may be applied to the supporting member 14 and the loop 14*a* to pull the bight portion 12 of the fastening member 10 back through the opening 18. Alternatively, the legs 11 may be compressed together until the outer lateral distances encompassed by the cam locks 20 is slightly smaller than the size of the openings 18 then the fastening member 10 may be passed back through the opening 18. At this point the inward pressure on the legs 11 may be released whereupon they will spring outwardly and the cam locks 20 will engage one surface of the slat 19 adjacent the edge of the opening 18 while the facing surfaces of the abutments 13 engage the opposite surface of the slat 19. FIG. 2 shows the fastening member in its final position of use.

To remove the fastening member 10 from the opening 18 the abutments 13 are pressed together flexing the legs 11 towards each other until the cams 20 are no longer engaged with the slat 19 and can pass back through the opening 18. Thereupon the fastening member 10 is rotated 90° and passed endwise through the opening 18 in the same manner as described above for insertion and as shown both for insertion and removal in FIG. 3.

Figure 4:
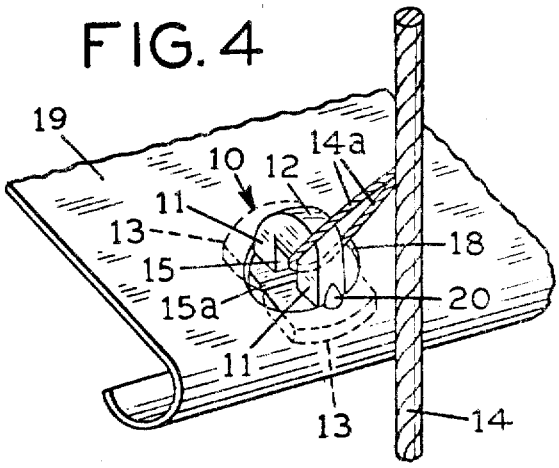
FIGS. 4 to 6 show a fastening member fully inserted in an opening in a slat in which the fastener is inserted in a slat opening from above, from below, and in an opening in the lateral edge of the slat respectively.

In FIG. 4 the opening 18 for the fastening member is shown on the upper surface of slat 19.

Figure 5:
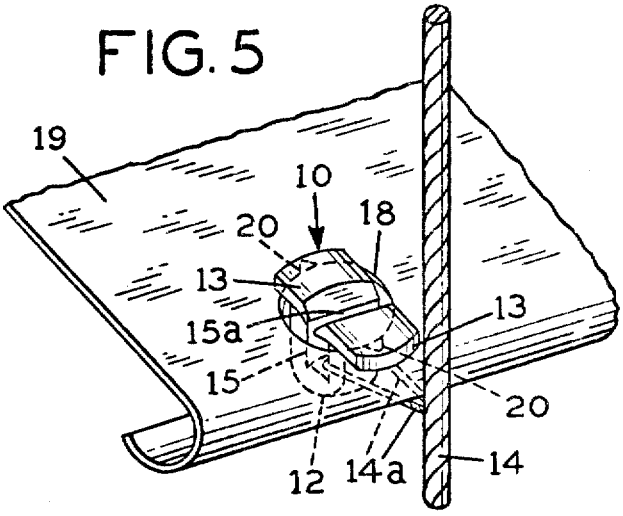

In FIG. 5 the slat 19 has a curved lateral longitudinal edge and the opening 18 is in substantially the same position, though perhaps closer to the edge, as in FIG. 4; however, the fastening member 10 has been inserted from below and the curved edge of the slat rests on the loop 14*a*. Thus in FIG. 4 the loop 14*a* applies force generally upwardly against the fastening member 10 which is retained in place by the lateral abutments 13 bearing against the under surface of slat 19 thus resisting the forces applied by loop 14*a* and supporting member 14. In FIG. 5 the loop 14*a* generally applies a force downwardly (with some component laterally) and, again, the force is resisted by the lateral abutments 13 which bear against the upper surface of slat 19.

Figure 6:
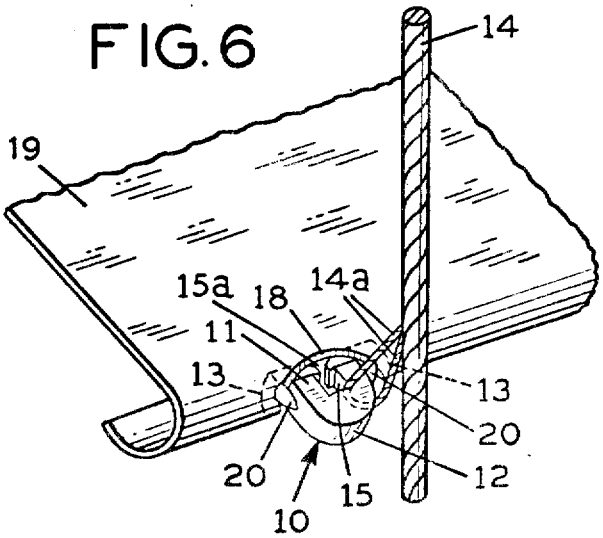

In FIG. 6 the opening 18 is in the curve or lateral edge of the slat 19 and the bight portion 12 of the fastening member 10 extends outwardly of the slat. Again, the loop 14*a* applies a directional force which is resisted by the abutments 13 bearing against the under or inner side of the slat 19.

In some constructions rather than the curved lateral edges shown in FIGS. 4, 5 and 6 there may be a generally squared or rectangular edge with two right angular bends along the lateral edges with the fastening member passing through an opening in any one of several places including the upper surface of the slat proper, the lateral slat side edge and the lower narrow flange of the side edge.

Various other modifications and variations will be apparent to those skilled in the art as falling within the spirit of the appended claims with different shapes for the openings 18 and for the lateral edges of the slats 19 having been mentioned among others.

I claim:

1. In a fastening member for fastening the slats of a venetian blind to a flexible support member which slats have openings therein for receipt of said fastening member, the fastening member comprising a portion extending through an opening of a slat the improvement comprising said fastening member being generally "U" shaped in configuration, the outer ends of the legs of said "U" having outwardly extending abutments, the overall dimension of said fastening member in a direction measured from the outer terminus of one abutment to the outer terminus of the other abutment being greater than the opening in said slat, all cross-sections of said fastening member taken at right angles to said direction being of such shape and size as to permit said fastening member to be passed in said direction entirely through the opening in said slat.

2. In a fastening member for fastening the slats of a venetian blind to a flexible support member which slats have openings therein for receipt of said fastening member, the fastening member comprising a portion extending through an opening of a slat the improvement comprising said fastening member being generally "U" shaped in configuration, the outer ends of the legs of said "U" having outwardly extending abutments, the overall dimension of said fastening member in a first direction measured from the outer terminus of one abutment to the other terminus of the other abutment being greater than the opening in said slat, the overall dimension of said fastening member in a second direction taken at right angles to said first direction being smaller than the opening in said slat, an opening between the legs of said fastening member for engagement by a support element secured to said support member, a slot between adjacent surfaces of said abutments, said slot communicating with said opening, said slot defined by the inner facing surfaces of said abutments being such that upon flexing of said legs toward each other and the meeting of said inwardly facing surfaces of said abutment the distance between the outer edges of said cams is such as to permit said fastening member to be passed through said opening in said slat, and the distance between the outer termini of said abutments when said legs are flexed to bring the inner surfaces thereof into contact being greater than the opening in said slat.

3. In a fastening member for fastening the slats of a venetian blind to a flexible support member which slats have openings therein for receipt of said fastening member, the fastening member comprising a portion extending through an opening of a slat the improvement comprising said fastening member being generally "U" shaped in configuration, the outer ends of the legs of said "U" having outwardly extending abutments, the overall dimension of said fastening member in a first direction measured from the outer terminus of one abutment to the outer terminus of the other abutment being greater than the opening in said slat, and the overall dimension of said fastening member in a second direction taken at right angles to said first direction and generally parallel to the legs of said "U" being smaller than the opening in said slat.

4. The fastening member of claim 3 in which the overall dimension of said fastening member in a third direction taken at right angles to both said first and said second directions is smaller than the opening in said slat, whereby the fastening member may be passed entirely through the opening in said slat without substantial deformation thereof.

5. The fastening member of claim 1, or claim 10, or claim 11 wherein said fastening member includes an opening between the legs of said fastening member for engagement by a support element secured to said support member, and a slot between adjacent surfaces of said abutments communicating with said opening.

6. A fastening member according to claim 5 in which each of the legs of said member has on the outer surface thereof a locking cam, each of said locking cams having a surface thereof facing toward said abutments, and the distance between said surface facing said abutments and the facing surfaces of said abutments corresponding generally to the thickness of the slat.

7. The fastening member of claim 6 in which the portion of said fastening member positioned between said facing surfaces of said locking cam and said abutment is shaped and sized to correspond to the opening in said slat.

8. The fastening member of claim 7 in which the outer surface of the bight of said "U" shaped fastening member and the outer surface of said abuttments when viewed in end view are rounded, and the opening in said slat being similarly rounded and of slightly larger dimension.

9. The fastening member according to claim 5 in which said slot defined by the inner facing surfaces of said abuttments is such that upon flexing of said legs toward each other and the meeting of said inwardly facing surfaces of said abuttment, the distance between the outer edges of said cams is such as to permit said fastening member to be passed through said opening in said slat; and the distance between the outer termini of said abuttments when said legs are flexed to bring the inner surfaces thereof into contact being greater than the opening in said slat.

* * * * *

UNITED STATES PATENT AND TRADEMARK OFFICE

CERTIFICATE OF CORRECTION

PATENT NO. : 4,236,567

DATED : December 2, 1980

INVENTOR(S) : Kurt H. Frentzel

It is certified that error appears in the above—identified patent and that said Letters Patent is hereby corrected as shown below:

The title page and the sole sheet of drawing should be deleted to appear as per attached.

Signed and Sealed this

*Seventh* Day of *April 1981*

[SEAL]

*Attest:*

RENE D. TEGTMEYER

*Attesting Officer*

*Acting Commissioner of Patents and Trademarks*

United States Patent [19]

Frentzel

[11] 4,236,567

[45] Dec. 2, 1980

[54] FASTENING MEMBER FOR SECURING THE SLATS OF A VENETIAN BLIND TO A SUPPORT ELEMENT AND METHOD FOR ASSEMBLY

[75] Inventor: Kurt H. Frentzel, Zevenhoven, Netherlands

[73] Assignee: Hunter Douglas International N.V., Netherlands Antilles

[21] Appl. No.: 911,824

[22] Filed: Jun. 2, 1978

[30] Foreign Application Priority Data

Jun. 7, 1977 [DE] Fed. Rep. of Germany ..... 2725600

[51] Int. Cl.[3] ..... E06B 9/38

[52] U.S. Cl. ..... 160/178 R

[58] Field of Search ..... 160/173, 177, 178 R, 160/178 F

[56] References Cited

U.S. PATENT DOCUMENTS 3,916,973 11/1975 Schuppler et al. ..... 160/178 R

FOREIGN PATENT DOCUMENTS 186404 8/1954 Austria ..... 160/178 R

*Primary Examiner*—Peter M. Caun

*Attorney, Agent, or Firm*—Pennie & Edmonds

[57] ABSTRACT

This invention relates to a fastening member for securing the slats of a venetian blind onto a flexible support element and to the method of assembling such slats to the support elements. The fastening member comprises a generally "U" shaped member in which the legs of the "U" have at their outer ends laterally outwardly extending abutments for engagement on one side of the slat while the remainder of the fastening member extends through an opening through the slat. A loop on the flexible support element passes between the legs of the "U" thus tending to hold the abutments in engagement with the surface of the slat. On the opposite side of the slat cam locks are provided such that upon flexure of the legs toward each other the cams will pass through the opening in the slat and then upon release when the legs resume their normal position the cams will engage and lock the slat in position between the cam locks and the aforesaid abutments. A narrow entrance slot with a tapered entrance throat provides for passage therethrough of the loop thus permitting passage of the loop between the legs into the space therebetween. Importantly, the fastening member is so dimensioned in one direction that the abutments are larger than the opening in the slat. In a second direction substantially perpendicular to said first direction the fastening member is dimensioned to pass through the opening in the slat. After engagement with the loop the fastening member is passed through the opening in the slat, rotated 90 degrees, and then all but the abutment portion of the fastening member is snapped back through the opening.

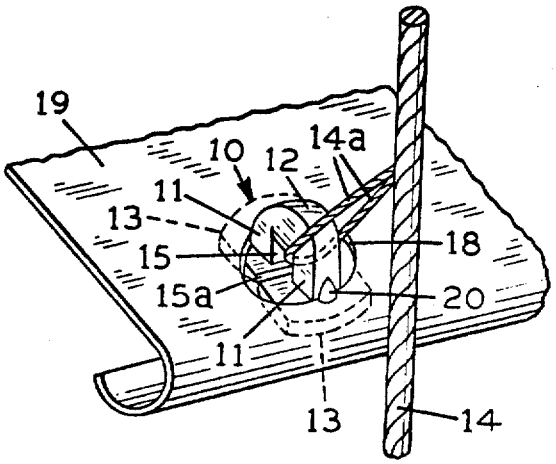

9 Claims, 6 Drawing Figures